US005749344A

United States Patent [19]

Yoshiume et al.

[11] Patent Number: 5,749,344

[45] Date of Patent: May 12, 1998

[54] FUEL SUPPLY CONTROL FOR INTERNAL COMBUSTION ENGINE BY INTAKE AIR PRESSURE ESTIMATION

[75] Inventors: Naoki Yoshiume; Makoto Miwa, both of Kariya, Japan

[73] Assignee: Denso Corporation, Kariya, Japan

[21] Appl. No.: 760,987

[22] Filed: Dec. 5, 1996

[30] Foreign Application Priority Data

Dec. 20, 1995 [JP] Japan ..... 7-331335

[51] Int. Cl.[6] ..... F02M 37/08

[52] U.S. Cl. ..... 123/399; 123/458; 123/497

[58] Field of Search ..... 123/399, 456, 123/458, 464, 497

[56] References Cited

U.S. PATENT DOCUMENTS 5,211,150 3/1993 Anzai ..... 123/480

5,215,062 6/1993 Asano et al. ..... 123/480 X 5,483,940 1/1996 Namba et al. ..... 123/497

5,546,911 8/1996 Iwamoto et al. ..... 123/497

5,586,539 12/1996 Yonekawa et al. ..... 123/497 X

*Primary Examiner*—Tony M. Argenbright

*Attorney, Agent, or Firm*—Nixon & Vanderhye P.C.

[57] ABSTRACT

Throttle valve opening and engine rotational speed are detected to estimate intake air pressure. Fuel consumption Q is estimated from the estimated intake air pressure. Fuel pump drive voltage is calculated from estimated intake air pressure and estimated fuel consumption through a data map. This map is set in advance from data measured experimentally. By thus driving the fuel pump, it can be controlled at an earlier (i.e., advanced) relative time by taking the response time delay of the control system and the fuel pump into consideration.

22 Claims, 7 Drawing Sheets

FUEL SUPPLY CONTROL FOR INTERNAL COMBUSTION ENGINE BY INTAKE AIR PRESSURE ESTIMATION

BACKGROUND OF THE INVENTION

1. Field of the Invention

The present invention relates to a fuel supply control for an internal combustion engine wherein the pressure of fuel (fuel pressure) supplied to fuel injecting valves is regulated by estimation of an intake air pressure.

2. Description of Related Art

In a fuel supplying apparatus according to Japanese Unexamined Patent Application Publication No. Hei 6-147047, for example, the basic fuel pump discharge amount is set in accordance with the operating state of an internal combustion engine, e.g., the rotational speed of the engine. The amount of the fuel injection, and a feedback correction amount is calculated in accordance with the difference between a target fuel pressure and actual fuel pressure. A required fuel pump discharge amount is then calculated by adding the correction amount to the basic discharge amount and is used for controlling a voltage applied to the fuel pump.

In the conventional fuel supplying apparatus, engine operating state is monitored to determine a required fuel pump discharge amount. In the case of such a fuel pump control, however, the control system and the fuel pump have a response time delay between the detection of a change in engine operating state and an actual change in fuel pump discharge amount. As a result, the change in fuel discharge amount delays behind the change in actual fuel consumption which takes place in the engine, giving rise to a temporary deviation of fuel pressure. The deviation of fuel pressure, in turn, causes a shift in the fuel injection amount which has an undesired effect on vehicle drivability and exhaust gas emission.

SUMMARY OF THE INVENTION

The present invention therefore has an object to improve the response characteristic of a fuel pump control to a change in operating state which occurs in an internal combustion engine.

According to the present invention, intake air pressure is estimated from the operating state of the internal combustion engine and a fuel pump is controlled in accordance with the estimated intake air pressure in an intake pipe of the engine. Thai is, by taking response time delay of the control system and fuel system into consideration, the fuel pump is controlled with timing ahead of normal timing by the response time delay. In this way, the time response characteristic of the fuel pump to a change in operating state occurring in the internal combustion engine and, thus, a change in intake air pressure can be improved. As a result, fuel pressure deviation accompanying a change in intake air pressure can be suppressed, allowing the pressure of the fuel to be better stabilized.

In an electronic throttle control system, the response time delay of the control system and the fuel pump is taken into consideration in changing a control amount of the fuel pump in accordance with estimated intake air pressure, and it is desirable to change the control amount of the fuel pump with timing in advance of an operation to start driving a throttle valve by a period of time corresponding to the response time delay. As a result, timing of a change in fuel pump discharge amount can be adjusted to timing of a change in intake air pressure due to a change in throttle valve opening, allowing fuel pressure deviation accompanying a change in intake air pressure to be suppressed and, thus, the pressure of the fuel to be stabilized.

It is desirable to estimate intake air pressure from throttle valve opening. That is, because a change in intake air pressure is mainly attributed to a change in throttle valve opening, it is possible to estimate intake air pressure from throttle valve opening with a high degree of accuracy.

It is also desirable to estimate intake air pressure from the amount of accelerator operation. Because the throttle valve is driven in a manner interlocked with accelerator operation, a fixed relation between the amount of accelerator operation and the opening of the throttle valve is maintained. As a result, changes in intake air pressure caused by changes in throttle valve opening can be estimated with a high degree of accuracy from the amount of accelerator operation in place of the opening of the throttle valve.

It is also desirable to set the time duration between the start of a change in fuel pump control amount and the start of an operation to drive the throttle valve at a value based on the operating condition of the internal combustion engine when changing the control amount of the fuel pump in accordance with estimated intake air pressure. This is because the control amount of the fuel pump is changed in accordance with the operating state of the internal combustion engine and, the larger the change range of the control amount of the fuel pump, the longer the response time delay of the fuel pump. For this reason, by setting the time duration between the start of a change in fuel pump control amount and the start of an operation to drive the throttle valve at a value based on the operating condition of the internal combustion engine, the discharge amount of the fuel pump can be changed with timing adjusted to variations in intake air pressure caused by changes in throttle valve opening without regard to the operating condition of the internal combustion engine, that is, without regard to the change range of the control amount of the fuel pump.

BRIEF DESCRIPTION OF THE DRAWINGS

Other objects, features and advantages of the present invention will become more apparent from the following detailed description made with reference to the accompanying drawing, in which.

DETAILED DESCRIPTION OF PRESENTLY PREFERRED EMBODIMENTS

Figure 1:
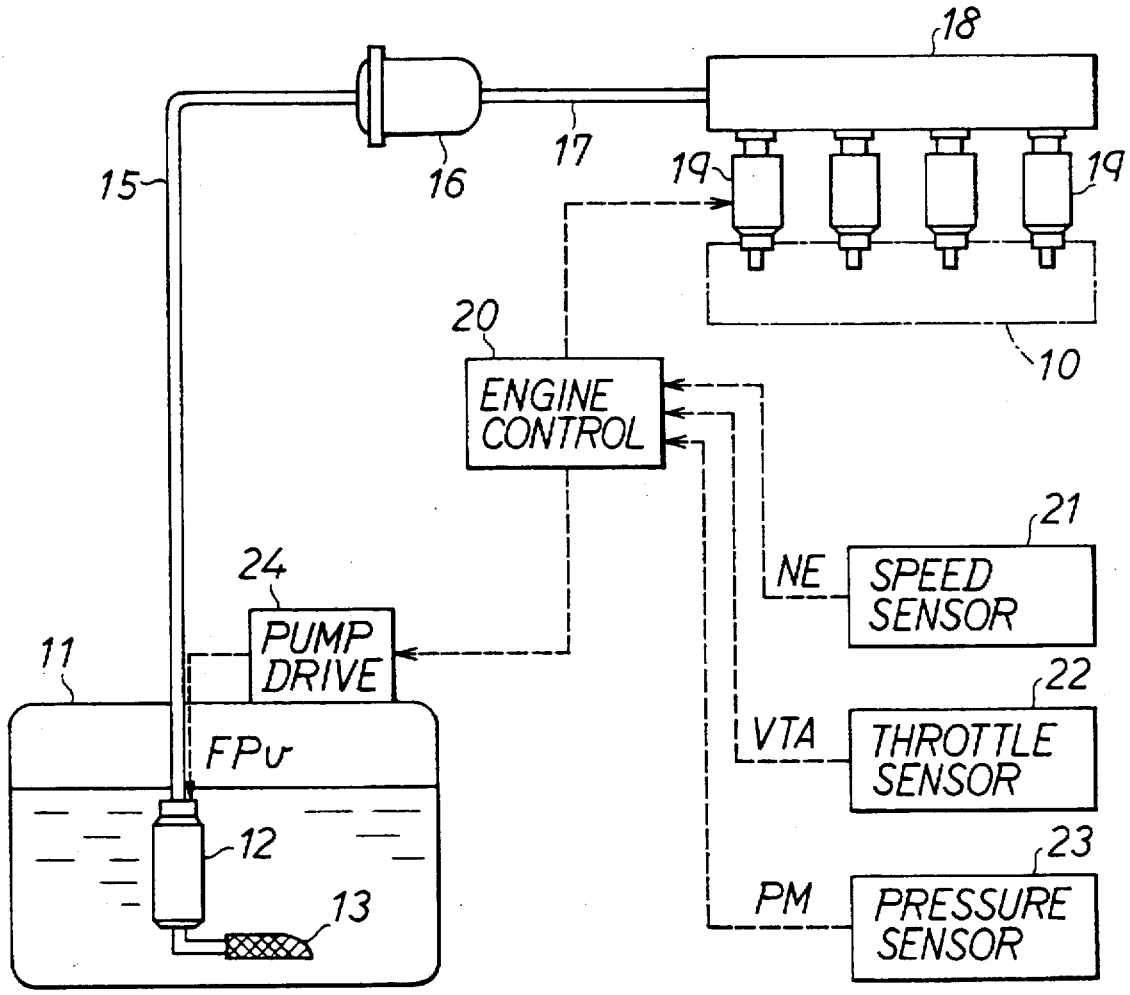
FIG. 1 is a schematic diagram a of a fuel supplying system provided according to a first embodiment of the present invention.

According to the first embodiment of the invention shown in FIG. 1, a fuel pump 12 is installed inside a fuel tank 11 and a filter 13 is mounted on the inlet of the fuel pump 12. An electric direct-current motor, which is not shown in the figure, is embedded in the fuel pump 12. Fuel discharged by the fuel pump 12 is supplied to a delivery pipe 18 by way of a fuel passage in the following order: from a fuel pipe 15, to a fuel filter 16 and finally to another fuel pipe 17. The fuel is then injected to cylinders of an internal combustion engine 10 from a delivery pipe 18 by way of fuel injecting valves 19 which are installed on the delivery pipe 18 for the cylinders. As shown in the figure, the fuel supply system has a fuel returnless pipe structure in which a fuel return pipe for returning excess fuel from the delivery pipe 18 to the fuel tank 11 is eliminated in order to make the structure simple.

An electronic engine control unit 20 reads in a variety of information output by sensors representing parameters of the operating state of the engine such as the rotational speed NE of the engine output by an engine rotational speed sensor 21, a throttle valve opening VTA output by a throttle sensor 22 and the intake air pressure (or the amount of air taken in) output by a pressure sensor 23. It then calculates, based on such information, the ignition timing, the amount of fuel injection and the target fuel pressure. These quantities are in turn used as bases for driving the fuel injecting valve 19 of each cylinder and for controlling an electronic pump driving circuit 23 for driving the fuel pump 12 by a pump drive voltage FPv. The pump driving circuit 23 is typically a PWM (Pulse Width Modulation) circuit, a DC-DC converter or the like. The pump driving circuit 23 varies a voltage FPv applied to the fuel pump 12 in accordance with a voltage command value output by the engine control unit 20 in order to change the rotational speed of the fuel pump 12 and, thus, the fuel pressure and the discharge amount.

Figure 2:
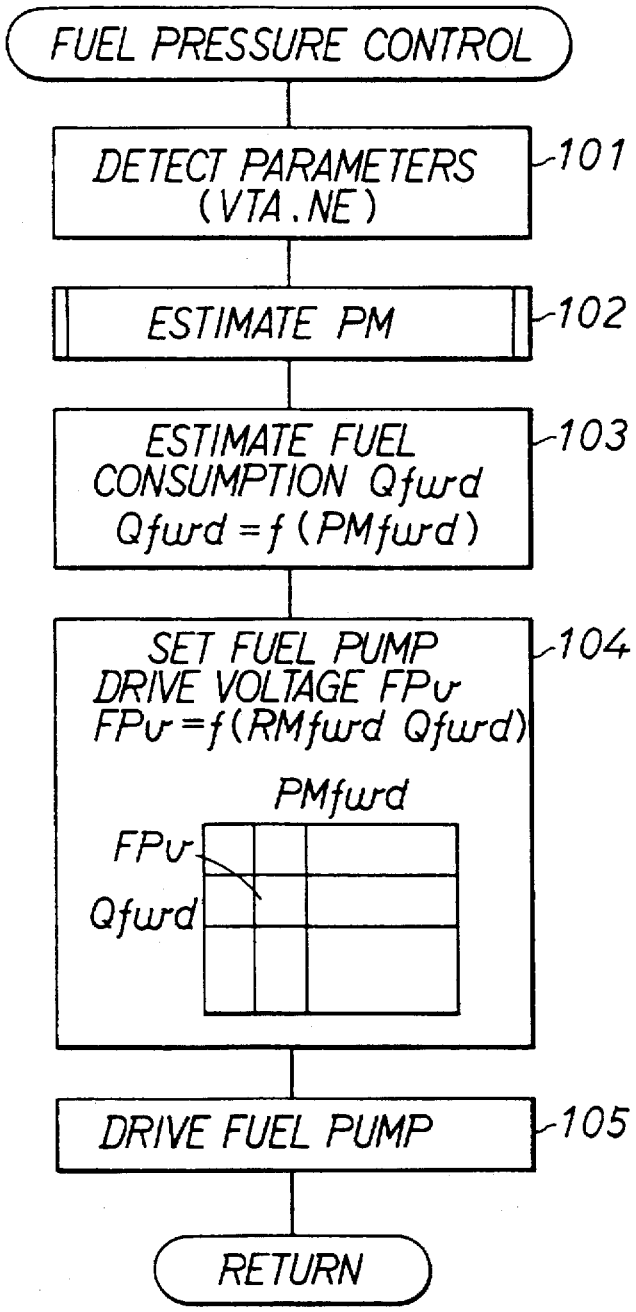
FIG. 2 is a flowchart showing a flow of processing carried out by execution of a fuel control routine in the first embodiment.

Executing a fuel pressure control routine shown in FIG. 2, the engine control unit 20 functions to adjust the pressure of the fuel by controlling the rotational speed of the fuel pump 12. The fuel pressure control routine shown in FIG. 2 is executed as an interrupt routine for each predetermined period of time or a predetermined crank angle after an ignition switch (not shown in the figure) is turned on for engine operation. First of all, when the processing in accordance with this fuel pressure control routine is started, quantities such as the throttle valve opening VTA, the rotational speed NE and the intake air pressure PM of the engine are read in as operating state parameters of the engine 10 at a step 101. The processing flow then goes on to a step 102 at which intake air pressure PM are estimated in order to find an estimated value PMfwd of the intake air pressure PM by executing a routine shown in FIG. 3 for estimating an intake air pressure PM.

Figure 4:
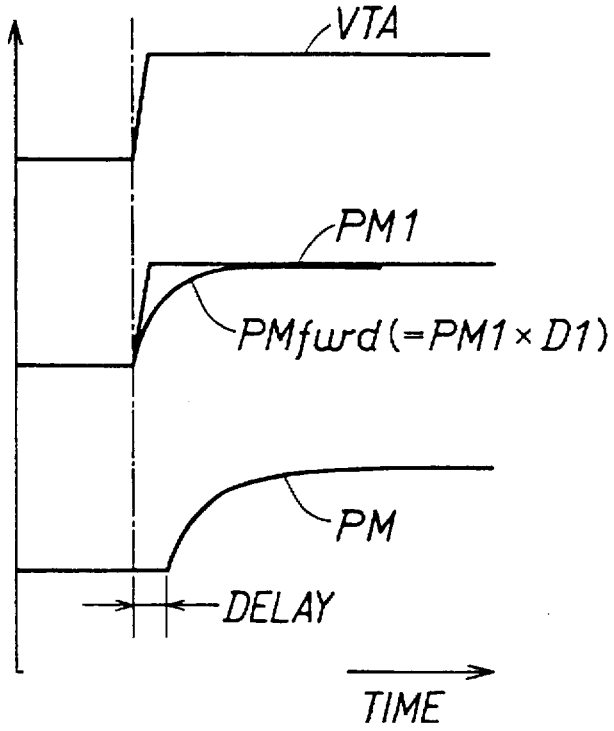
FIG. 4 is a time chart showing typical changes in throttle valve opening VTA and intake air pressure PM.
Figure 5:
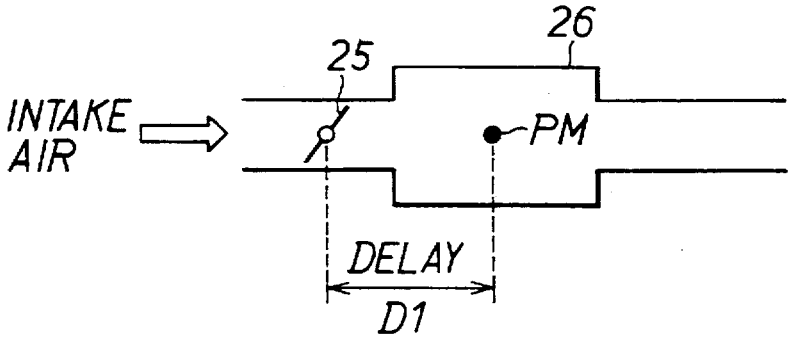
FIG. 5 is a schematic diagram showing an intake air flow delay starting at a throttle valve and ending at a surge tank.

Here, a technique used for estimating the intake air pressure PM is explained. Assuming that a pressure in a surge tank 16 installed at the downstream side of a throttle valve 25 as shown in FIG. 5 is the intake air pressure PM to be estimated. A delay corresponding to a propagation time constant D1 exists between the time the throttle valve opening VTA changes and the time the intake air pressure PM actually changes. As shown in FIG. 4, the intake air pressure PM actually changes with the delay following the change in throttle valve opening VTA.

The intake air pressure PM is estimated by multiplying PM1 by the propagation time constant D1 to give an estimated value PMfwd where PM1 is an estimated intake air pressure obtained from the throttle valve opening VTA and the rotational speed NE of the engine by assuming that the delay caused by the propagation time constant D1 does not exist at all. In this case, because the propagation time constant D1 changes depending upon the operating state, the propagation time constant is set in accordance with the throttle valve opening VTA and the rotational speed NE of the engine.

Figure 3:
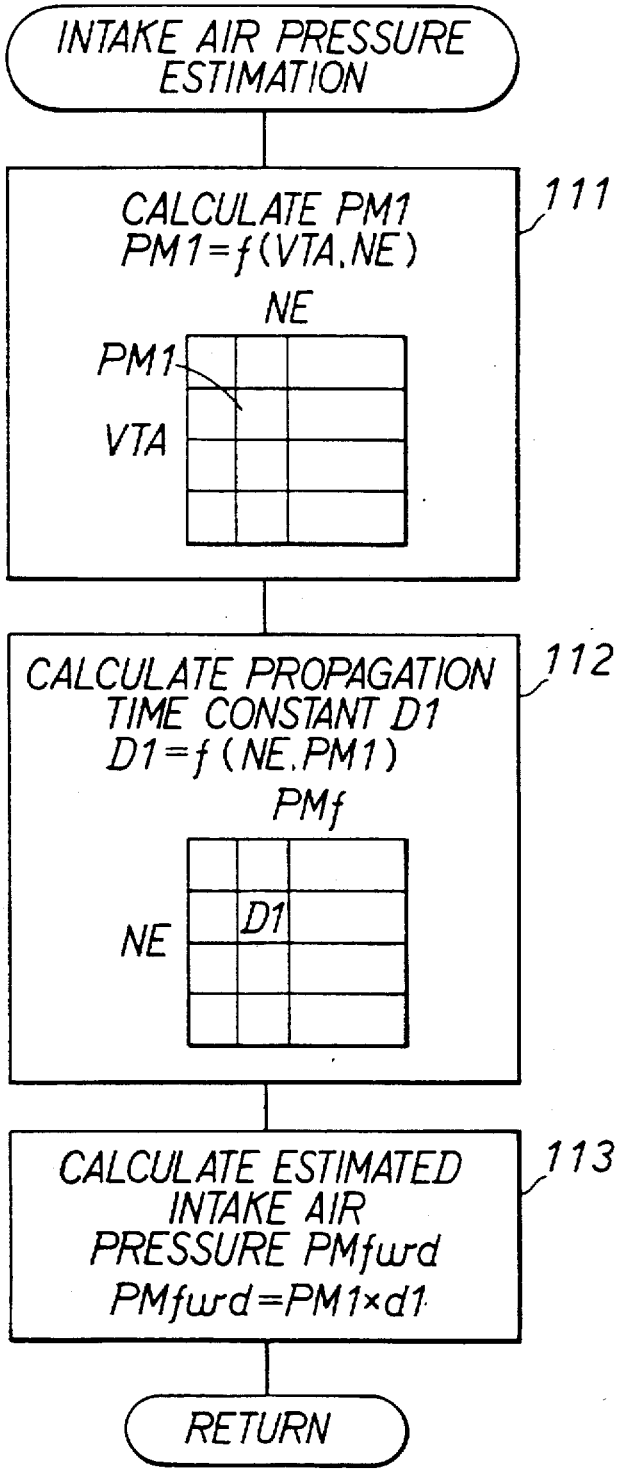
FIG. 3 is a flowchart showing a flow of processing carried out by execution of a routine for estimating an intake air pressure in the first embodiment.

The estimation of the intake air pressure PM described above is carried out by executing the routine for estimating the intake air pressure shown in FIG. 3. First of all, at a step 111 of the processing flow shown in the figure, an intake air pressure PM1 based on the assumption that a delay due to the propagation time constant D1 does not exist at all is determined from the throttle valve opening VTA and the rotational speed NE of the engine through a data map which has VTA and NE as parameters. This map may be set in advance from data measured in a steady state in experiments or the like. The processing flow then goes on to a step 112 at which the propagation time constant D1 from the throttle valve 25 to the surge tank 26 is determined from the throttle valve opening VTA and the rotational speed NE of the engine through a data map which has VTA and NE as parameters. This map may be set in advance as well from data measured in experiments or the like. Finally, the processing flow proceeds to a step 113 at which the intake air pressure PM1 determined at the step 111 is multiplied by the propagation time constant D1 determined at the step 112 to give an estimated value PMfwd of the intake air pressure PM.

Completing the routine for estimating the intake air pressure shown in FIG. 3, the processing flow returns to a step 103 shown in FIG. 2 at which the amount of fuel consumption Q is estimated from the estimated value PMfwd of the intake air pressure PM through a map set in advance to give an estimated value Qfwd of the amount of fuel consumption Q.

The estimated intake air pressure PMfwd determined at the step 102 and the estimated fuel consumption amount Qfwd determined at the step 103 can be compared with the actual intake air pressure PM and the actual amount of fuel consumption Q respectively in order to correct the estimated value PMfwd and Qfwd. In this case, it is necessary to read in the actual intake air pressure PM and the actual amount of fuel consumption Q at the step 101.

After calculating the estimated value Qfwd of the amount of fuel consumption Q, the processing flow goes on to a step 104 at which the voltage FPv to be applied to the fuel pump 12 is determined from the estimated intake air pressure PMfwd and the estimated fuel consumption amount Qfwd through a data map which has PMfwd and Qfwd as parameters. This map may be set in advance as well from data measured in experiments or the like. Finally, the processing flow goes on to a step 105 at which a signal representing the voltage FPv determined at the step 104 is output to the pump driving circuit 23 in order to apply the voltage FPv to the fuel pump 12 for driving the fuel pump 12.

Figure 6:
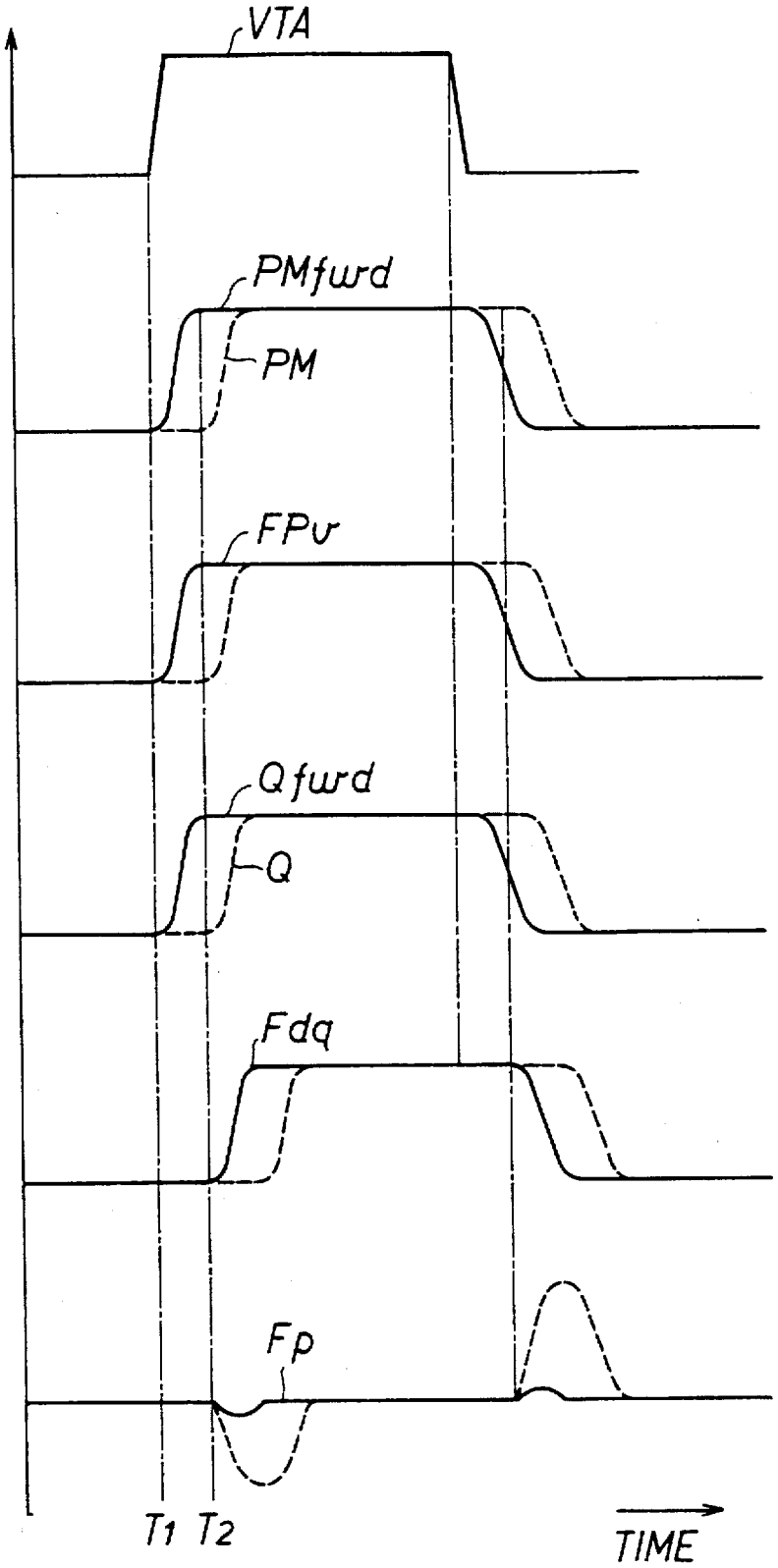
FIG. 6 is a time chart showing variations in parameters used in fuel pressure control in the first embodiment.

An operational advantage of the embodiment resulting from the execution of such control is explained by referring to a time chart shown in FIG. 6. There is a time delay of the order of several tens of milliseconds from a change in throttle valve opening VTA at time T1 to an actual change in intake air pressure PM (shown by a dotted line) at time T2. Thus, if the voltage FPv applied to the fuel pump 12 is controlled as shown by a dotted line only after an actual change in intake air pressure PM has been detected, the discharge amount Fdq output by the fuel pump 12 can not follow the change in intake air pressure PM as shown by a dotted line. As a result, a deviation of the pressure of the fuel results each time the throttle valve VTA changes, that is, each time the intake air pressure PM changes, giving rise to a phenomenon wherein the fuel pressure Fp and the fuel amount Q temporarily deviate from a target fuel pressure as shown respectively by dotted lines. The deviation in fuel pressure, in turn, results in a deviation in amount of injected fuel, becoming a cause of an undesired effect on drivability and exhaust gas emission.

In the case of the first embodiment described above, considering the fact that the intake air pressure PM changes, delaying behind a change in throttle valve opening VTA by a time delay of the order of several tens of milliseconds, changes in intake air pressure PM are estimated from throttle valve opening VTA. An estimated value Qfwd of the amount of fuel consumption Q is then determined from an estimated value PMfwd of the intake air pressure PM and the voltage FPv applied to the fuel pump 12 is controlled in accordance with the estimated value Qfwd of the amount of fuel consumption Q and the estimated value PMfwd of the intake air pressure PM. In this way, by taking the response time delay of a control system and a fuel pump into consideration, it becomes possible to control the voltage FPv applied to the fuel pump 12 in timed relation with an operation to start driving a throttle valve without the response time delay, as shown by dotted lines. Thus, the voltage FPv applied to the fuel pump can be varied following a change in the throttle valve opening VTA, allowing timing for a change in discharge amount occurring at the pump 12 to be adjusted to timing T2 for an actual change in intake air pressure PM. As a result, fuel can be discharged sufficiently, keeping up with changes in amount of fuel consumption Q and a deviation of the fuel pressure resulting from a change in intake air pressure PM can be suppressed, allowing the pressure of the fuel to be stabilized. Thus, the control characteristics of the fuel pressure can be improved, allowing drivability and exhaust gas emission to be improved as well.

As described above, in the case of the first embodiment, an intake air pressure is estimated from the throttle valve opening VTA and the rotational speed NE of the engine. It should be noted, however, that an intake air pressure can also be estimated from the throttle valve opening VTA only. Other operating state parameters can also be added in the estimation of an intake air pressure in addition to the throttle valve opening VTA and the rotational speed NE of the engine. Because a change in intake air pressure is mainly attributed to a change in throttle valve opening VTA, an intake air pressure can be estimated with a high degree of accuracy if the throttle valve opening VTA is used as a primary data for estimation.

Figure 7:
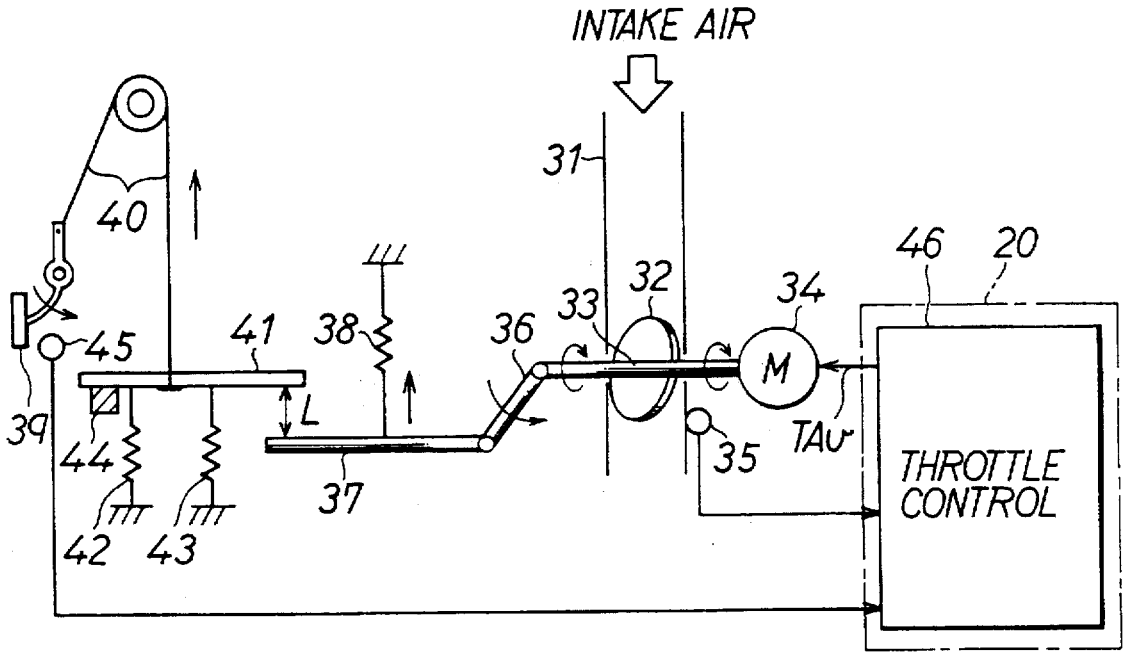
FIG. 7 is a schematic diagram of an electronic throttle system according to a second embodiment of the present invention.
Figure 8:
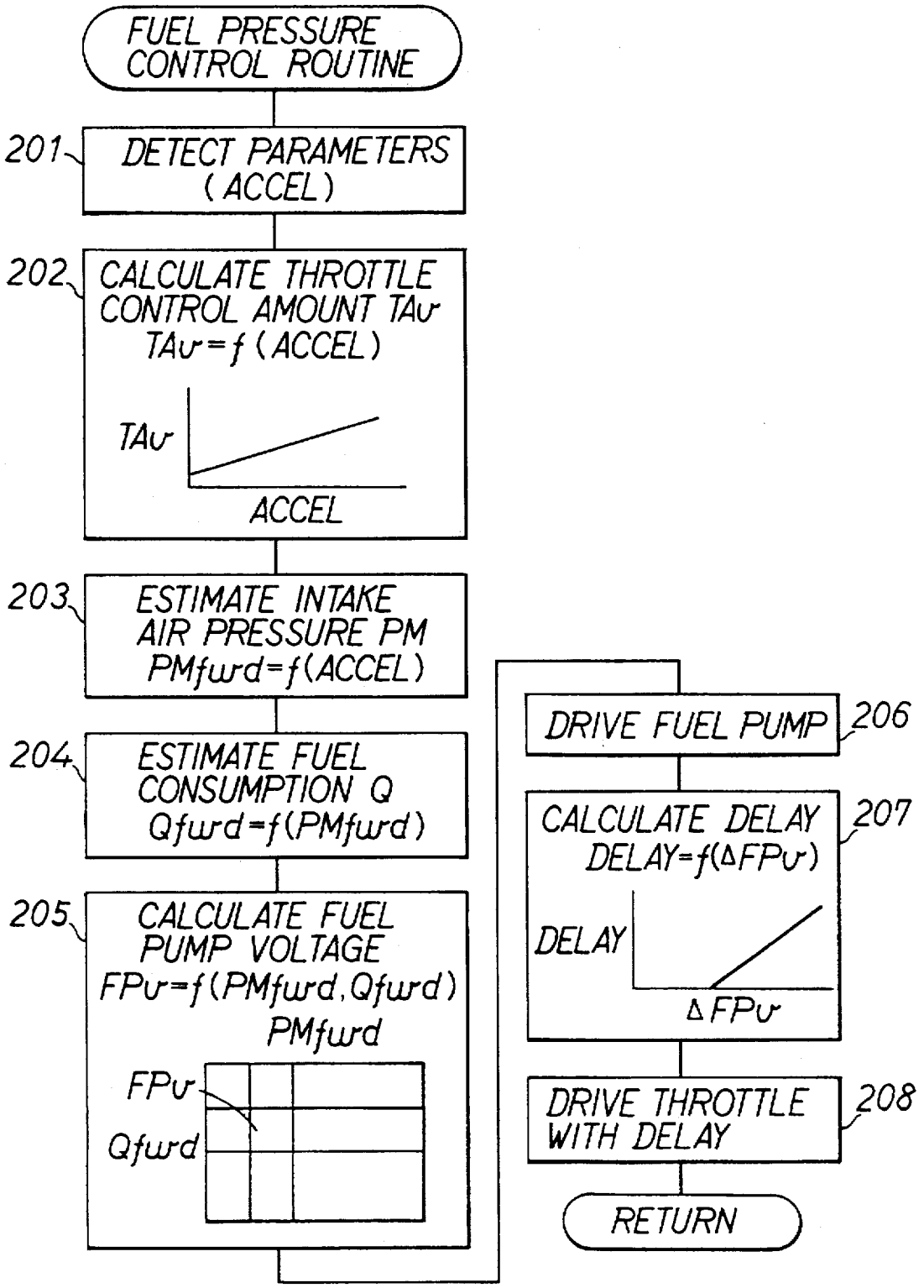
FIG. 8 is a flowchart showing the flow of processing carried out by execution of a fuel pressure control routine in the second embodiment.

Next, a second embodiment of the invention applied to an electronic throttle control system is explained by referring to FIGS. 7 and 8. First of all, as shown in FIG. 7, an electric motor 34 is interlocked with one end of a rotary shaft 33 of a throttle valve 32 installed inside an intake pipe 31. The opening of the throttle valve 32 regulated by the motor 34 is sensed by a throttle sensor 35. In addition, an interlock member 37 is fixed to the other end of the rotary shaft 33 of the throttle valve 32 through a link member 36. The interlock member 37 is pulled up by a spring 38, biasing normally the throttle valve 32 in a direction of throttle opening for air flow to the engine. It should be noted that arrows shown in the figure all indicate the opening direction of the throttle valve 32.

An accelerator pedal 39 is connected to a throttle opening controlling member 41 by way of a wire 40. The throttle opening controlling member 41 is pulled down normally by springs 42 and 43 in a direction of throttle closing. When the accelerator pedal 39 is not operated, that is, when the accelerator pedal 39 is not depressed and is in an idle state, the throttle opening controlling member 41 is held in a state in contact with a stopper 44 by the springs 42 and 43. In this state, a small gap L exists between the throttle opening controlling member 41 and the interlock member 37. Idle speed control (ISC) is carried out by moving the interlock member 37 up and down within the range of the gap L, that is, by adjusting the opening of the throttle valve 32 by way of solely the motor 34.

When the accelerator pedal 39 is operated by pressing it down by foot, the throttle opening controlling member 41 is pulled up by the wire 40 by as much a distance as the pressing down of the accelerator pedal 39 and the throttle 32 can be driven in the opening direction by as much an amount as the pulling up distance of the throttle opening controlling member 41. At that time, the amount of operation (that is, the acceleration opening) ACCEL of the acceleration pedal 39 is detected by an accelerator sensor 45 which then supplies a detection signal representing the acceleration opening ACCEL to a throttle control circuit 46 which may be a part of the engine control unit 20 of the first embodiment. Receiving the detection signal representing the acceleration opening ACCEL, the throttle control circuit 46 outputs a signal TAv to the motor 34 for controlling the throttle valve 32 in accordance with the detection signal representing the acceleration opening ACCEL. In this way, the opening of the throttle valve 32 is regulated. The configuration other than the electronic throttle system described above is the same as that of the first embodiment.

Next, the processing flow of the fuel pressure control routine executed by the control unit 20 is explained by referring to FIG. 8. First of all, at a step 201 of the fuel pressure control routine shown in the figure, the detection signal representing the acceleration opening ACCEL generated by the accelerator sensor 45 is read in order to detect the operating state of the engine. The processing flow then goes on to a step 202 at which a control amount TAv of the throttle valve 32 is determined from the acceleration opening ACCEL through a predetermined data map. The processing flow then proceeds to a step 203 at which intake air pressure PM is estimated from the acceleration opening ACCEL in order to determine an estimated value PMfwd of the intake air pressure PM. The processing flow then continues to a step 204 at which fuel consumption amount Q is estimated in order to determine an estimated value Qfwd of the amount of fuel consumption Q.

The processing flow then goes on to a step 205 at which the voltage FPv applied to the fuel pump 12 is determined from the estimated intake air pressure PMfwd and the estimated fuel consumption amount Qfwd through a data map which has PMfwd and Qfwd as parameters. This map may be set in advance from data measured in experiments or the like. Finally, the processing flow goes on to a step 206 at which a signal representing the voltage FPv determined at the step 205 is output to the pump driving circuit 23 in order to apply the voltage FPv to the fuel pump 12 for driving the fuel pump 12.

The processing flow then proceeds to a step 207 at which a time delay DELAY from the start of a change in voltage applied to the fuel pump 12 to the start of driving of the throttle valve 32 is determined or calculated from the change in applied voltage ΔFPv through a predetermined data map.

This map may also be set in advance from data measured in experiments or the like. A relation between the time delay DELAY and the change in applied voltage ΔFPv is set in the map. According to the relation, the time delay DELAY=0 for changes in applied voltage ΔFPv of equal to and smaller than a predetermined value. For changes in applied voltage ΔFPv of greater than the predetermined value, the greater the change in applied voltage ΔFPv, the longer the time delay DELAY. For changes in applied voltage ΔFPv of greater than the predetermined value, the time delay DELAY increases continuously or in steps. In the map, a response-time-delay characteristic of the fuel pump 12 is taken into consideration. The response time delay of the fuel pump 12 is attributed to the fact that, the greater the change in applied voltage ΔFPv, the greater the change in discharge amount of the fuel pump 12, and thus, the longer the time it takes to change the discharge amount to the requested value. By using the map, a proper time delay DELAY can be determined without regard to the magnitude of the change in applied voltage ΔFPv.

After the time delay DELAY is determined, the processing flow goes on to a step 208 at which a signal representing the control amount TAv of the throttle valve 32 determined at the step 202 is output to the motor 34 after the time delay DELAY has lapsed in order to adjust the opening of the throttle valve 32 to TAv.

In the case of the second embodiment described above, the response time delay of the control system and the fuel pump 12 is taken into consideration in changing the control amount of the fuel pump 12 and the voltage FPv applied to the fuel pump 12 is changed with timing preceding the start to drive the throttle valve 32. As a result, the timing for a change in discharge amount of the fuel pump 12 can be adjusted to the timing for a change in intake air pressure caused by a change in throttle valve opening, allowing a deviation of the fuel pressure accompanying a change in intake air pressure to be suppressed and, thus, the pressure of the fuel to be stabilized in order to improve the control characteristic of the fuel pressure.

Taking the response-time-delay characteristic of the fuel pump 12 into consideration, a data map of the relation between the time delay DELAY from the start of a change in voltage applied to the fuel pump 12 to the start of the driving of the throttle valve 32 and the change in voltage applied to the fuel pump 12 ΔFPv is set so that, the greater the change in voltage ΔFPv, the longer the time delay DELAY. As a result, the time delay DELAY can be set at a proper value without regard to the magnitude of the change in applied voltage ΔFPv.

Figure 9:
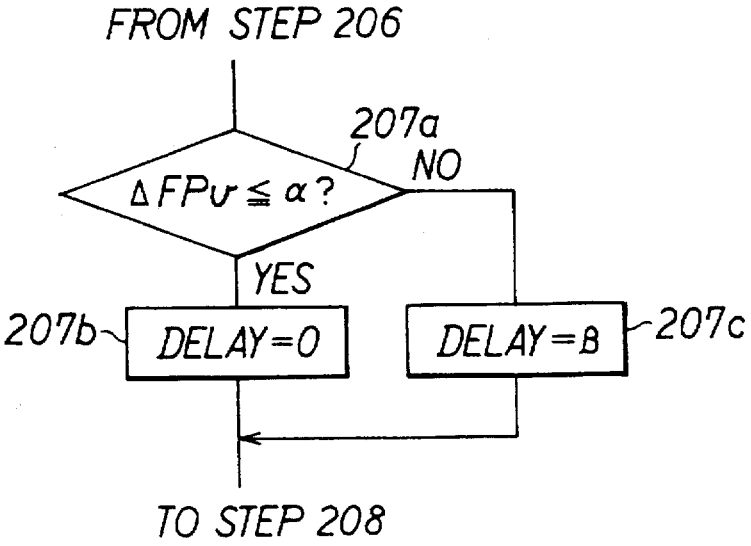
FIG. 9 is a flowchart showing a modification for setting a delay time DELAY.

As described above, in the case of the second embodiment, at the step 207 shown in FIG. 8, the time delay DELAY is determined from the change in applied voltage ΔFPv through the predetermined data map. It should be noted, however, that the processing carried out at the step 207 shown in FIG. 8 can be replaced by processing performed at steps 207*a* to 207*c* shown in FIG. 9. That is, at the step 207*a*, the change in applied voltage ΔFPv is compared with a predetermined value α. If the change in applied voltage ΔFPv is equal to or smaller than the predetermined value α, the processing flow goes on to the step 207*b* at which the time delay DELAY is set to zero. This is because, for a change in applied voltage ΔFPv equal to or smaller than the predetermined value α (ΔFPv≦α), the change in applied voltage is gradual so that the response time delay does not give rise to a problem. If the change in applied voltage ΔFPv is greater than the predetermined value α, on the other hand, the processing flow proceeds to the step 207*c* at which the time delay DELAY is set to β. This is because, for a change in applied voltage ΔFPv greater than the predetermined value α(ΔFPv>α), the change in applied voltage is abrupt so that the response time delay can not be ignored.

In addition, in the case of the second embodiment, the intake air pressure is estimated from the acceleration opening ACCEL at the step 203 shown in FIG. 8. It should be noted, however, that the intake air pressure can also be estimated as well from the control amount TAv of the throttle valve 32 which is calculated at the step 202 shown in FIG. 8. Much like the acceleration opening ACCEL, there is a fixed relation between the control amount TAv and the throttle valve opening VTA. As a result, changes in intake air pressure caused by changes in throttle valve opening can be estimated with a high degree of accuracy from either the control amount TAv of the throttle valve 32 or the accelerator opening ACCEL.

Other modifications and alterations may further be made without departing from the spirit and the scope of the present invention.

What is claimed is:

1. A fuel supply control apparatus for an internal combustion engine have a throttle valve and a fuel tank, the apparatus comprising:

a fuel injecting valve for injecting fuel to said engine;

an electrically-driven fuel pump for supplying fuel from said fuel tank to said fuel injecting valve;

intake air pressure estimating means for estimating intake air pressure which will occur at a point downstream of said throttle valve after a transport delay of intake air from an operating state of said engine which influences the intake air pressure after the transport delay; and fuel pump controlling means for regulating fuel pressure supplied to said fuel injecting valve by controlling fuel pump rotational speed, said controlling means controlling the fuel pump rotational speed in accordance with the estimated intake air pressure.

2. A fuel supply control apparatus as in claim 1, wherein:

said intake air pressure estimating means estimates said intake air pressure from throttle valve opening.

3. A fuel supply control apparatus as in claim 1, wherein:

said intake air pressure estimating means estimates said intake air pressure from operation of an acceleration pedal.

4. A fuel supply control apparatus for an internal combustion engine having a fuel tank, the apparatus comprising:

a fuel injecting valve for injecting fuel to said engine;

an electrically-driven fuel pump for supplying fuel from said fuel tank to said fuel injecting valve;

intake air pressure estimating means for estimating intake air pressure from an operating state of said engine which influences the intake air pressure; and fuel pump controlling means for regulating pressure of fuel supplied to said fuel injecting valve by controlling rotational speed of said fuel pump, said controlling means controlling fuel pump rotational speed in accordance with estimated intake air pressure;

wherein said intake air pressure estimating means estimates said intake air pressure from a throttle control signal of an electronic throttle control system which controls a throttle valve electronically in accordance with operation of an accelerator.

5. A fuel supply control apparatus as in claim 4, wherein:

said fuel pump controlling means sets a time delay, in accordance with an operating state of said engine, for delaying start control timing of said throttle valve by said electronic throttle control system relative to start control timing of said fuel pump, when changing control of said fuel pump in accordance with said estimated intake air pressure.

6. A fuel supply control apparatus for an internal combustion engine having a fuel tank, accelerator and a throttle valve, said apparatus comprising:

a fuel injecting valve;

an acceleration sensor for detecting accelerator operation;

throttle driving means for driving said throttle valve; and throttle controlling means for electronically controlling said throttle driving means so as to move said throttle valve in response to said operation of said accelerator pedal;

intake air pressure estimating means for estimating intake air pressure from an operating state of said engine other than said intake air pressure; and fuel pump controlling means for regulating fuel pressure supplied to said fuel injecting valve by controlling rotational speed of said fuel pump, said controlling means changing control of said fuel pump in accordance with the estimated intake air pressure before control of said throttle controlling means is started.

7. A fuel supply control apparatus as in claim 6, wherein:

said intake air pressure estimating means estimates said intake air pressure from operation of said accelerator.

8. A fuel supply control apparatus as in claim 6, wherein:

said intake air pressure estimating means estimates said intake air pressure from a throttle control signal of said electronic throttle control system.

9. A fuel supply control apparatus as in claim 6, wherein:

said fuel pump controlling means sets a time delay, in accordance with an operating state of said engine, for delaying start control of said throttle valve by said electronic throttle control system relative to start control of said fuel pump, when changing control of said fuel pump in accordance with said estimated intake air pressure.

10. A fuel supply control apparatus as in claim 9, wherein:

said time delay is increased as change in fuel pump speed control increases.

11. A fuel supply control method for controlling a fuel pump which supplies fuel from a fuel tank to a fuel injecting valve of an internal combustion engine, said method comprising the steps of:

detecting an engine operation state which changes in advance of a change in intake air pressure;

estimating intake air pressure, which will occur after an intake air transport delay from the time of said detection using said detected engine operation state; and driving said fuel pump in accordance with said estimated intake air pressure.

12. A control method as in claim 11, wherein:

said detecting step detects engine rotation speed and engine throttle valve opening as said engine operation state.

13. A fuel supply control method for controlling a fuel pump which supplies fuel from a fuel tank to a fuel injecting valve of an internal combustion engine, said method comprising the steps of:

detecting an engine operation state which changes in advance of a change in intake air pressure;

estimating intake air pressure from said detected engine operation state; and driving said fuel pump in accordance with said estimated intake air pressure;

wherein said detecting step detects engine throttle opening as said engine operation state; and wherein said estimating step estimates said intake air pressure by determining an air flow propagation time constant in accordance with said detected engine throttle opening and by correcting, by said time constant, intake air pressure corresponding to said detected engine throttle opening.

14. A control method for controlling a fuel pump which supplies fuel from a fuel tank to a fuel injecting valve of an internal combustion engine, said method comprising the steps of:

detecting an engine operation state which changes in advance of a change in intake air pressure;

estimating intake air pressure from said detected engine operation state;

driving said fuel pump in accordance with said estimated intake air pressure;

estimating a fuel consumption amount of said engine from said estimated intake air pressure; and applying an electric voltage to said fuel pump in accordance with said estimated intake air pressure and said estimated fuel consumption amount.

15. A control method for controlling a fuel pump which supplies fuel from a fuel tank to a fuel injecting valve of an internal combustion engine, said method comprising the steps of:

detecting an engine operation state which changes in advance of a change in intake air pressure;

estimating intake air pressure from said detected engine operation state;

driving said fuel pump in accordance with said estimated intake air pressure;

detecting accelerator operation; and driving a throttle valve of said engine electronically in accordance with said detected accelerator operation.

16. A control method as in claim 15, further comprising the step of:

delaying for a predetermined period start of said throttle valve driving step relative to start of said fuel pump driving step, at a time of change in driving said fuel pump.

17. A control method as in claim 16, further comprising the step of:

varying the predetermined period in accordance with a change in the amount of fuel pump driving by said fuel pump driving step.

18. A control method as in claim 16, wherein:

said varying step increases the predetermined period as said fuel pump driving amount change increases.

19. A method for controlling fuel supply to an internal combustion engine, said method comprising:

estimating an expected time-delayed change in engine state corresponding to a commanded change in engine state; and controlling the relative timing of (a) commanded change in the amount of fuel being supplied to the engine with respect to (b) the commanded change in engine state so as to anticipate and reduce undesirable transient fluctuations in fuel amounts actually supplied to the engine.

20. A method as in claim 19 wherein the engine state includes the state of engine intake air pressure and said controlling step controls the relative timing of commanded changes to (a) position of an air intake throttle valve and (b) fuel pump speed so as to compensate for different expected time delays in effecting changes to control of each of these variables under current engine conditions.

21. Apparatus for controlling fuel supply to an internal combustion engine, said apparatus comprising:

means for estimating an expected time-delayed change in engine state corresponding to a commanded change in engine state; and means for controlling the relative timing of (a) a commanded change in the amount of fuel being supplied to the engine with respect to (b) the commanded change in engine state so as to anticipate and reduce undesirable transient fluctuations in fuel amounts actually supplied to the engine.

22. Apparatus as in claim 21 wherein the engine state includes the state of engine intake air pressure and said means for controlling controls the relative timing of commanded changes to (a) position of an air intake throttle valve and (b) fuel pump speed so as to compensate for different expected time delays in effecting changes to control of each of these variables under current engine conditions.

* * * * *